United States Patent [19]

Millington

[11] Patent Number: 4,848,310

[45] Date of Patent: Jul. 18, 1989

[54] WINDOW MOUNTABLE HEATING DEVICE

[76] Inventor: Richard S. Millington, 1823 S. Ash Park, Boise, Id. 83709

[21] Appl. No.: 274,353

[22] Filed: Nov. 21, 1988

[51] Int. Cl.[4] ..... F24C 1/14

[52] U.S. Cl. ..... 126/4; 126/39 R; 126/39 E; 126/39 H; 126/39 K; 126/273 A; 126/520

[58] Field of Search ..... 126/520, 9 R, 37 B, 126/39 E, 39 H, 39 N, 39 C, 39 K, 39 R, 273 A

[56] References Cited

U.S. PATENT DOCUMENTS

| | | | |
|---|---|---|---|
| 1,681,068 | 8/1928 | Taylor | 126/39 K |
| 2,755,794 | 7/1956 | Wendell | 126/273 A |
| 3,667,450 | 6/1972 | Skafte | 126/39 R X |
| 3,794,013 | 2/1974 | Upton | 126/39 H X |
| 4,570,610 | 2/1986 | Himmel | 126/39 E |

*Primary Examiner*—Randall L. Green
*Attorney, Agent, or Firm*—Paul F. Horton

[57] ABSTRACT

A heating device for mounting in a window opening, particularly useful for vehicles, camper shells, and other enclosures, which includes a mounting plate; air intake and exhaust tubes, a burner contained within a sealed housing, an external fuel source, and a connecting line between the fuel source and the burner. The lower portion of the mounting plate rests upon the window sill and an upper portion engages the outer surface of the window framework to make the device useable for both vertically and horizontally movable windows. The sealed housing, which includes a cooking surface, precludes noxious fumes or explosive fumes from escaping into the confines of the area being heated. The external fuel source, preferably a portable propane tank, rests on the ground outside the enclosure, as an additional safety factor. A heat deflector, pivotal over the top surface of the burner housing, disperses the heated air to prevent overheating of the ceiling and also serves as a safety guard. Other guards may also be provided.

48 Claims, 1 Drawing Sheet

FIG. 1
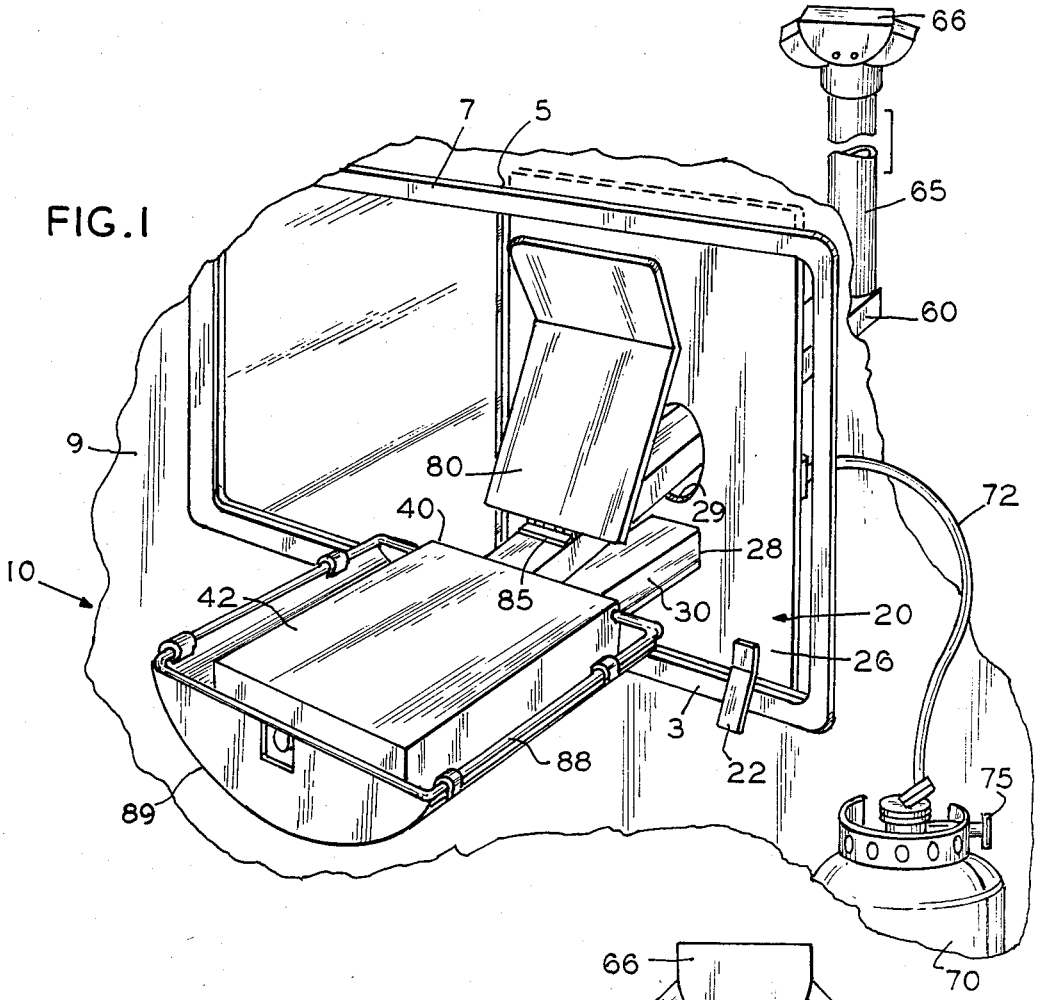
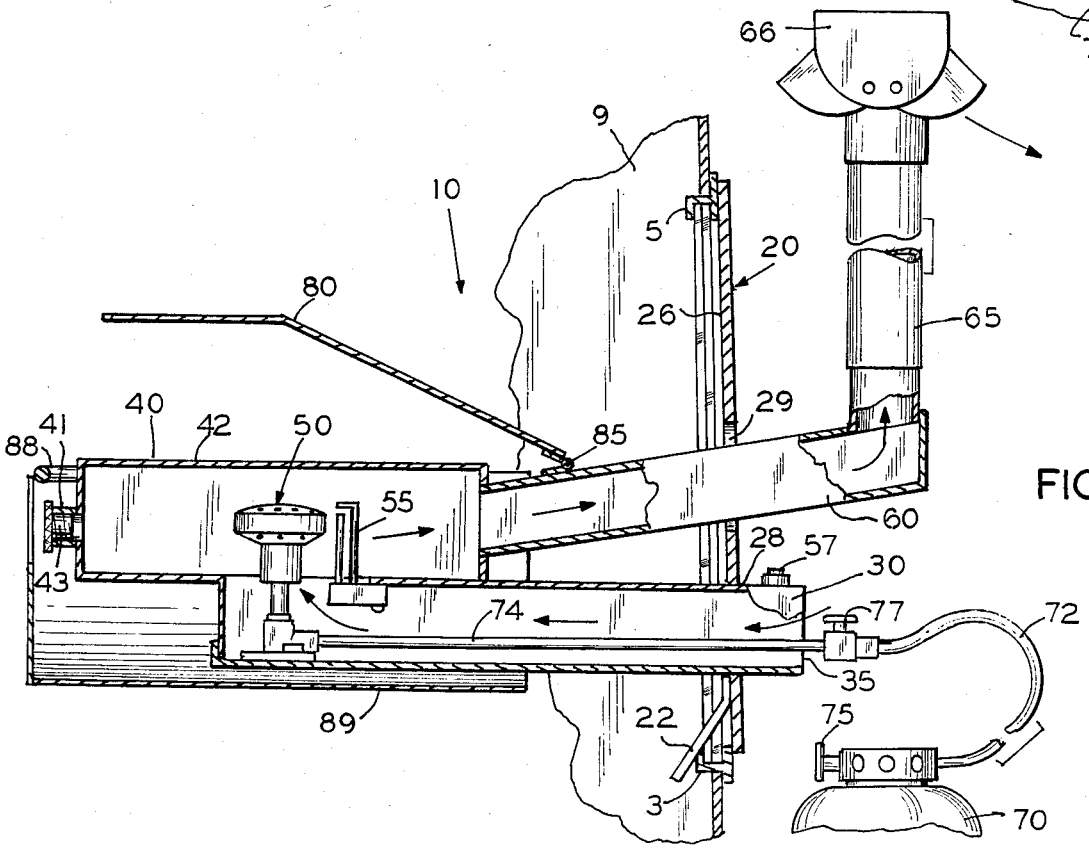
FIG. 2

WINDOW MOUNTABLE HEATING DEVICE

BACKGROUND OF THE INVENTION

1. Field of the Invention

This invention relates, in general, to portable heating devices, and, more particular, to heating & cooking devices of vehicles.

2. Description of the Prior Art

It is not uncommon for travelers, and hunters, in particular, to become stranded in their vehicles due to heavy snowfall, engine failure, mud slides, and for many unanticipated reasons. Frostbite or even death may result from exposure to cold temperatures.

Permanently mounted heaters for travel trailers, motor homes, and other recreational vehicles as well known, as typified by U.S. Pat. No. 2,523,569, issued to R. N. Harvey. Portable heaters are also well known as shown by U.S. Pat. No. 4,015,580, issued to L. V. Moore and U.S. Pat. No. 2,798,476, issued to W. F. Marion, Jr. Moore also discloses a unit which is "safe" in bringing in external air and exhausting the noxious fumes. The Moore device, however, is not useable in automobiles, pickups, trucks, and the like, in being floor mounted. Moore also contemplates the use of charcoal as a fuel and therefore requires a firebox door for feeding the fuel to the firebox. U.S. Pat. No. 4,518,189, issued to R. Belt, discloses a cooking unit mountable for the bed of a pickup, but the Belt device is not useable for heating the interior of a vehicle. U.S. Pat. No. 4,621,609, issued to J. A. Kitchen, shows a heater and food warmer which is mountable within a vehicle by mounting directly upon the window itself. Besides not being useable with horizontally sliding windows, commonly found on camper shells, the Kitchen device includes an internally located fuel, wax, utilizing a consumable burner, a wick. Such a fuel renders the heater potentially dangerous, both as to noxious fumes and as to fuel spillage, in that the fuel is in the form of a liquid contained within a drawer or tray in the heater. It is also questionable whether the candle-like arrangement can produce sufficient heat for warming the vehicle in subzero temperatures. An added danger is involved in that the fuel reservoir and burner must be removed for cooking.

SUMMARY OF THE INVENTION

These problems and others are solved by the present invention which comprises a mounting plate engagable with a window sill for use with horizontal or vertically sliding windows; a gas burner located within a sealed housing and connected with an external fuel tank to provide sufficient heat for heating and cooking without danger of explosion or noxious fumes; and an intake and exhaust duct extending into the atmosphere outside the plate and the enclosure within which the device is located.

Additional objects of the present invention are to provide a heating and cook device which may include an electrical ignition; which includes a heat deflector for dispersing heated air and for serving as a burn guard; and to provide a portable exhaust stack for extending the exhaust duct above the vehicle for safer operation.

Other objects and advantages will become apparent and a more thorough and comprehensive understanding may be had from the following description taken in conjunction with the accompanying drawings forming a part of this specification.

BRIEF DESCRIPTION OF THE DRAWINGS

FIG. 1 is a perspective view of one embodiment of the invention, shown mounted in a window opening.

FIG. 2 is a side sectional view of the device of FIG. 1.

DETAILED DESCRIPTION OF THE INVENTION

Referring now to the figures, an embodiment to be preferred of heating and cooking device 10, made according to the present invention is disclosed. Device 10 includes, generally, a mounting plate 20, an air intake tube 30, burner housing 40, burner 50, exhaust tube 60, fuel source 70, and heat deflector 80.

Mounting plate 20 is constructed of a thin plate or sheet of steel, or other suitable material, of desired width and of sufficient height to engage both the sill 3 and the outer surface 5 of the top of a window frame 7 of an enclosure such as camper shell 9, for example, as shown in FIG. 1. Plate 20, for engaging the sill, is provided with two laterally disposed tabs 22 which are angled downwardly and inwardly from interior surface 26 of the plate; only one of the tabs being shown. The plate is held in place within the window by tabs 22 and by the low center of gravity of the device, within shell 9, which holds the substantially vertical top portion of the plate firmly against the exterior top framework of the window.

Air intake tube 30, having an air intake port 35 located externally of plate 20, may also be constructed of steel and extends through an aperture 28 cut or formed in mounting plate 20 and is affixed, as by welding, to the plate at a selected angle so that tube 30 extends into the shell 9, or other enclosure, level with the ground, ie., substantially horizontal.

Mounted on tube 30 and in fluid communication therewith is a burner housing 40, also constructed of steel and having a flat, horizontal cooking surface 42 upon which ordinary cooking utensils such as pots and pans may be placed. Located within housing 40 is a metal burner 50, preferably for gaseous fuel such as propane. Burner 50 is connected to a fuel source 70, such as a propane tank, which is located externally of the vehicle or dwelling containing the burner. Tank 70 may be placed upon the ground and is fitted with a flexible fuel line 72 to a rigid fuel line 74 which is contained within air intake tube 30 and which is connected to and terminates at burner 50. Tank 70 is provided with the conventional on-off valve 75 and a second valve 77, adjacent the entrance of fuel line 74 into air intake tube 30, for "fine tuning" the flow of fuel. Burner housing 40 forms an air-tight seal with intake tube 30 and with exhaust tube 60 and may include a threaded aperture 41 for receiving a threaded plug 43 which sealingly engages the aperture, when in place, to prevent any noxious fumes from escaping within shell 9 of the vehicle or within the dwelling or other enclosure in which the device 10 is mounted, as the case may be. Aperture 41 is of sufficient size for the admittance of a match or other ignition device for igniting the fuel coming from the burner. If desired, device 10 may be provided with an electrical ignition device 55 of the spark gap type, commonly used with kerosene heaters or gas barbecues. Device 55 may be activated as by a push button mechanism 57 located in any desirable place.

Affixed to and in fluid communication with housing 40 is exhaust tube 60. Tube 60 extends outwardly into the atmosphere through aperture 29 which is of sufficient diameter to define an air gap between the tube and the mounting plate to insure introduction of fresh air and to prevent heat conductance by contact between the exhaust tube and the mounting plate. For safety reasons, a portable exhaust stack 65, having a cap 66 to prevent downdraft may be demountably attached to the external terminal end of exhaust tube 60. Stack 65 should be of sufficient height to extend above the vehicle or any closely surrounding objects.

To deflect heat laterally and to prevent hot spots from developing on surrounding objects such as the ceiling or sidewall, a pivotal heat deflector 80 is provided. Deflector 80 also serves as a guard to prevent accidental burns from contact with burner housing 40. Deflector 80 is preferably mounted on exhaust tube 60 by means of a suitable hinge 85, permitting the deflector to be pivoted from a down position, shown in FIG. 2, to a raised position, shown in FIG. 1. The deflector is placed in the down position when the device is used for heating and in the raised position when used for cooking.

As a further safeguard against accidental burns, heating device 20 may be provided with a lateral guard 88 in the form of a rod spaced from and about the periphery of the burner housing and a lower guard 89, downwardly depending from guard 88, constructed of curved sheet metal, slung below the burner housing. Guard 88 may be welded to the back of the burner housing, as shown, or to exhaust tube 60.

The device is installed in a window simply by placing mounting plate 20 on a window sill with tabs 22 resting on the sill and the top portion of the plate leaning against the top of the window frame with the burner housing extending inwardly into the enclosure of, for example, camper shell 9. Stack 65 is installed and propane tank 70 is placed on the ground outside the enclosure. The tank is then connected to rigid fuel line 74 by means of flexible line 72. Valve 75 is then opened and valve 77 opened to allow a small flow of propane to the burner. If the burner is to be ignited by a match, plug 43 is first removed; the lit match inserted through aperture 41 and the plug reinserted after ignition. The lit match should be inserted before activation of valve 77 to prevent a build up of gas. If electrical ignition 55 is to be used, the plug need not be removed; the burner being lit by pushing button mechanism 57 to cause a spark adjacent the burner. It is to be noted that, in that fuel line 74 is contained within the intake tube, that any leakage of the fuel from the line or its connection with the burner is contained within the intake tube 30, housing 40, or exhaust tube 60, all of which are open to atmosphere, and the gas cannot escape into the air within the enclosure of the shell 9, the vehicle, or the dwelling, in that the unit is completely sealed. If cooking is desired, the utensil is simply placed on the top surface of the burner housing with deflector 80 in the raised position.

Having thus described in detail preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A window mountable heating device comprising:

a mounting plate provided with window sill engagement means;

an air intake tube affixed to and extending through said plate;

a sealed burner housing mounted on and in fluid communication with said air intake tube, said burner housing provided with a top cooking surface for placement of cooking utensils;

a gas burner located within said housing;

an exhaust tube mounted on and in fluid communication with said burner housing, said tube exiting through said mounting plate;

a heat deflector pivotally mounted to said device, said deflector pivotal from a substantially horizontal position covering the top of said burner housing to a substantially vertical non-covering position;

a fuel source located externally of said mounting plate; and a fuel tube positioned within said air intake tube connecting said fuel source to said burner.

2. The heating device as described in claim 1 wherein said burner housing is provided with a threaded opening for igniting said burner and a threaded plug for sealing said housing after ignition.

3. The heating device as described in claim 1 further comprising electrical ignition means for igniting said burner.

4. A window mountable heating device comprising:

a mounting plate provided with window sill engagement means;

an air intake tube affixed to and extending through said plate;

a sealed burner housing mounted on and in fluid communication with said air intake tube; said housing provided with a threaded opening for igniting a burner and a threaded plug for sealing said housing after ignition;

a burner located within said housing;

an exhaust tube mounted on and in fluid communication with said burner housing, said tube exiting through said mounting plate;

a fuel source; and a fuel tube connecting said fuel source to said burner.

5. The heating device as described in claim 4 wherein said burner is a gas burner.

6. The heating device as described in claim 4 wherein said fuel source is external of said heating device.

7. The heating device as described in claim 4 wherein said fuel tube is positioned within said air intake tube.

8. The heating device as described in claim 4 wherein said burner housing includes a top, horizontal, and substantially planar cooking surface for placement of cooking utensils.

9. The heating device as described in claim 4 wherein said mounting plate includes a substantially vertical top portion for engaging the exterior surface of a window frame.

10. The heating device as described in claim 4 wherein said mounting plate defines an opening through which said exhaust tube exits to prevent heat conductive transfer between said tube and plate.

11. The heating device as described in claim 4 further comprising a heat deflector pivotally mounted to said device, said deflector pivotal from a substantially horizontal position covering the top of said burner housing to a substantially vertical, non-covering position.

12. The heating device as described in claim 4 further comprising electrical ignition means for igniting said burner.

13. The heating device as described in claim 4 further comprising an exhaust stack demountably secured to said exhaust tube for increasing the height of the exhaust above surrounding objects.

14. The heating device as described in claim 4 further comprising a burner housing guard extending about the front and side periphery of said housing.

15. A window mountable heating device comprising:

a mounting plate provided with window sill engagement means and said mounting plate defining an opening through which an exhaust tube exits to prevent heat conductive transfer between said tube and plate;

an air intake tube affixed to and extending through said plate;

a sealed burner housing mounted on and in fluid communication with said air intake tube;

a burner located within said housing;

an exhaust tube mounted on and in fluid communication with said burner housing, said tube exiting through said mounting plate;

a fuel source; and a fuel tube connecting said fuel source to said burner.

16. The heating device as described in claim 15 wherein said burner is a gas burner.

17. The heating device as described in claim 15 wherein said fuel source is external of said heating device.

18. The heating device as described in claim 15 wherein said fuel tube is positioned within said air intake tube.

19. The heating device as described in claim 15 wherein said burner housing includes a top, horizontal, and substantially planar cooking surface for placement of cooking utensils.

20. The heating device as described in claim 15 wherein said mounting plate includes a substantially vertical top portion for engaging the exterior surface of a window frame.

21. The heating device as described in claim 15 further comprising a heat deflector pivotally mounted to said device, said deflector pivotal from a substantially horizontal position covering the top of said burner housing to a substantially vertical, non-covering position.

22. The heating device as described in claim 15 further comprising electrical ignition means for igniting said burner.

23. The heating device as described in claim 15 further comprising an exhaust stack demountably secured to said exhaust tube for increasing the height of the exhaust above surrounding objects.

24. The heating device as described in claim 15 further comprising a burner housing guard extending about the front and side periphery of said housing.

25. A window mounting heating device comprising:

a mounting plate provided with window sill engagement means;

an air intake tube affixed to and extending through said plate;

a sealed burner housing mounted on and in fluid communication with said air intake tube;

a burner located within said housing;

an exhaust tube mounted on and in fluid communication with said burner housing, said tube exiting through said mounting plate;

a fuel source;

a fuel tube connecting said fuel source to said burner;

and a heat deflector pivotally mounted to said device, said deflector pivotal from a substantially horizontal position covering the top of said burner housing to a substantially vertical, non-covering position.

26. The heating device as described in claim 25 wherein said burner is a gas burner.

27. The heating device as described in claim 25 wherein said fuel source is external of said heating device.

28. The heating device as described in claim 25 wherein said fuel tube is positioned within said air intake tube.

29. The heating device as described in claim 25 wherein said burner housing includes a top, horizontal, and substantially planar cooking surface for placement of cooking utensils.

30. The heating device as described in claim 25 wherein said mounting plate includes a substantially vertical top portion for engaging the exterior surface of a window frame.

31. The heating device as decribed in claim 25 further comprising electrical ignition means for igniting said burner.

32. The heating device as described in claim 25 further comprising an exhaust stack demountably secured to said exhaust tube for increasing the height of the exhaust above surrounding objects.

33. The heating device as described in claim 25 further comprising a burner housing guard extending about the front and side periphery of said housing.

34. A window mountable heating device comprising:

a mounting plate provided with window sill engagement means;

an air intake tube affixed to and extending through said plate;

a sealed burner housing mounted on and in fluid communication with said air intake tube;

a burner located within said housing;

an exhaust tube mounted on and in fluid communication with said burner housing, said tube exiting through said mounting plate;

a fuel source;

a fuel tube connecting said fuel source to said burner;

and a burner housing guard extending about the front and side periphery of said housing.

35. The heating device as described in claim 34 wherein said burner is a gas burner.

36. The heating device as described in claim 34 wherein said fuel source is external of said heating device.

37. The heating device as described in claim 34 wherein said fuel tube is positioned within said air intake tube.

38. The heating device as described in claim 34 wherein said burner housing includes a top, horizontal, and substantially planar cooking surface for placement of cooking utensils.

39. The heating device as described in claim 34 wherein said mounting plate includes a substantially vertical top portion for engaging the exterior surface of a window frame.

40. The heating device as described in claim 34 further comprising electrical ignition means for igniting said burner.

41. The heating device as described in claim 34 further comprising an exhaust stack demountably secured to said exhaust tube for increasing the height of the exhaust above surrounding objects.

42. A window mountable heating device comprising:

a mounting plate provided with window sill engagement means;

an air intake tube affixed to and extending through said plate;

a sealed burner housing mounted on and in fluid communication with said air intake tube;

a gas burner located within said housing;

an exhaust tube mounted on and in fluid communication with said burner housing, said tube exiting through said mounting plate;

a fuel source located externally of said mounting plate;

a fuel tube positioned within said air intake tube connecting said fuel source to said burner; and a heat deflector pivotally mounted to said device, said deflector pivotal from a substantially horizontal position covering the top of said burner housing to a substantially vertical, non-covering position.

43. The heating device as described in claim 42 wherein said burner housing includes a top, horizontal, cooking surface for placement of cooking utensils.

44. The heating device as described in claim 42 wherein said burner housing is provided with a threaded opening for igniting said burner and a threaded plug for sealing said housing after ignition.

45. The heating device as described in claim 42 further comprising electrical ignition means for igniting said burner.

46. A window mountable heating device comprising:

a mounting plate provided with window sill engagement means;

an air intake tube affixed to and extending through said plate;

a sealed burner housing mounted on and in fluid communication with said air intake tube, said housing provided with a threaded opening for igniting said burner and a threaded plug for sealing said housing after ignition;

a gas burner located within said housing;

an exhaust tube mounted on and in fluid communication with said burner housing, said tube exiting through said mounting plate;

a fuel source located externally of said mounting plate; and a fuel tube positioned within said air intake tube connecting said fuel source to said burner.

47. The heating device as described in claim 46 wherein said burner housing includes a top, horizontal, cooking surface for placement of cooking utensils.

48. The heating device as described in claim 46 further comprising electrical ignition means for igniting said burner.

* * * * *